United States Patent [19]

Appelquist et al.

[11] 4,117,294

[45] Sep. 26, 1978

[54] SAFETY ARRANGEMENT FOR MICROWAVE OVENS

[75] Inventors: Jan Olov Appelquist; Conny Holger Lindwall, both of Nörrköping, Sweden

[73] Assignee: U.S. Philips Corporation, New York, N.Y.

[21] Appl. No.: 693,944

[22] Filed: Jun. 8, 1976

[30] Foreign Application Priority Data

Jun. 12, 1975 [SE] Sweden ..... 7506751

[51] Int. Cl.[2] ..... H05B 9/06

[52] U.S. Cl. ..... 219/10.55 C; 200/52A; 307/141.4; 307/141.8

[58] Field of Search ..... 219/10.55 C, 10.55 B; 200/52 A, 50 A, 61, 62; 307/141.8, 141.4

[56] References Cited

U.S. PATENT DOCUMENTS 3,624,334 11/1971 Chapell ..... 219/10.55 C 3,766,437 10/1973 Fritts ..... 219/10.55 C 3,857,067 12/1974 Zanboorie ..... 219/10.55 C

*Primary Examiner*—J. V. Truhe

*Assistant Examiner*—Bernard Roskoski

*Attorney, Agent, or Firm*—Frank R. Trifari; Bernard Franzblau

[57] ABSTRACT

A safety interlock system for microwave ovens comprising first and second interconnected switches activated by the oven door. Each switch has make-and-break contacts. The first switch interrupts the current to the microwave source when the door is opened and the second switch monitors the operation of the first switch. The switches are connected in series with a fuse so that a malfunction of either of the switches makes the oven immediately unusable. A delay element is connected within one switch and the first switch is arranged to operate before the second switch when the door is initially opened. The delay element is a negative temperature coefficient (N.T.C) resistor.

7 Claims, 3 Drawing Figures

SAFETY ARRANGEMENT FOR MICROWAVE OVENS

The invention relates to a safety arrangement for microwave ovens comprising a first switch controlled by the oven door and adapted to interrupt the current supply to the oven microwave generator upon the opening of the door and a second monitoring switch, also controlled by the door and adapted to monitor the function of the first switch. Both switches have the shape of make-and-break contacts, the fixed contact elements of which are mutually interconnected so that a current path between the movable contact elements only arises when the two switches assume different positions, a so called "landing switch" circuit, i.e. one switch assumes the position it has when the door is closed and the second switch assumes the position it has when the door is open or vice versa. The movable contact elements of the switches are included in a current path comprising a circuit control element which, when the said current path is closed, makes the oven unusable.

When using such a safety arrangement the oven is made unusable as soon as any of the switches sticks in the one or the other position. The two switches therefore can be regarded as monitoring each other, i.e. the first switch, which in reality is the monitored switch, will at the same time monitor the second switch, which is added only for the purpose of monitoring the first switch.

Furthermore there is often at least one further switch (micro-switch) which indirectly interrupts the generation of microwave energy as soon as the oven door is opened.

Safety authorities require or will require that if one of the switches used for interrupting the current supply to the microwave generator in dependence upon the opening of the door malfunctions, the oven shall be made unusable within one second after the beginning of the opening of the door. The expression "made unusable" means that it shall not be possible to put the oven into operation without the help of a serviceman, who then also repairs the primary cause of the malfunction, i.e. replaces the faulty switch.

In the above described safety arrangement having a first switch in the shape of a make-and-break contact for interrupting the current supply to the microwave generator and a second switch, also in the shape of a make-and-break contact, for monitoring the first switch, which switches are interconnected so as to form a switching circuit, i.e. a so called "landing switch" circuit which is connected to a circuit control element for making the oven unusable, if the current path through the said "landing switch" circuit is closed a problem arises in that the said "landing switch" circuit is closed for a short while during opening and closing of the door, even if both switches function properly. Closing of the said current path will, as mentioned, take place as soon as the two switches assume different positions. The only way to be sure that there will be no closing of the current path containing the aforesaid circuit control element will be to ensure that the two switches function at exactly the same moment upon the opening and the closing of the door. This, however, is impossible to achieve in practice. Consequently there will always be a short excitation of the said circuit control element upon the opening and the closing of the door even when the two switches function properly. The length of this excitation will be dependent upon the speed of the door motion and thus the time of excitation of the said element, which makes the oven unusable, can be extended in case of a slow door motion.

Now, if the activation time for the said circuit control element is made so short that the arrangement fulfills the safety requirements it may happen, if no special measures were taken, that the said circuit control element is also activated by the excitation which is caused by properly functioning switches in the event of a slow door motion. Say, for example, that the said element is adjusted so as to function and make the oven unusable within 0.2 – 0.5 seconds after the beginning of the opening of the door in the case of a real error in the switches. In order to achieve that the oven is not made unusable unintentionally in the case of properly functioning switches at a slow door motion, it then must be ensured that the difference between the time moments, when the two switches function at the opening and closing of the door, under no circumstances can amount to 0.2 – 0.5 seconds. This may be difficult to achieve and consequently it may happen that the oven is made unusable even in the case of properly functioning switches.

An object of the invention is to solve this problem which has been achieved in that the two switches are so adjusted that the first switch, which is adapted to interrupt the current supply to the microwave generator, functions before the second monitoring switch upon the opening of the door, and that a delay means is included in the internal branch of the "landing switch" circuit leading to that fixed contact element in the said first switch which comes in touch with the movable contact element when the door is opened.

By means of the invention it is thus intentionally ensured that the current path through the "landing switch" circuit is momentarily closed during opening and closing of the door, but this always occurs in a special way, namely through the branch leading to the make contact (at the opening of the door) in the first switch, in which the delay means is included. As a result the circuit control element which makes the oven unusable, will be delayed and will not have time to react to the short lasting excitation through the delay means which takes place when both switches function properly and the door is opened.

In the event that the first switch sticks in the position it shall have, when the door is closed, in which it delivers the supply voltage to the microwave generator, which is the only really dangerous condition to be monitored, the delay means will not be effective because the current path then will be closed through the second branch in the "landing switch" circuit, which leads to the break contact in the first switch (at the opening of the door) not containing any delay means. Thus the circuit control element which makes the oven unusable will in this case be excited without delay. By means of the invention the safety arrangement can be arranged to make the oven unusable rapidly in the case of a faulty switch and without risk that the oven is made unusable unintentionally due to a slow door motion.

The invention is illustrated in the accompanying drawings, in which.

Figure 1:
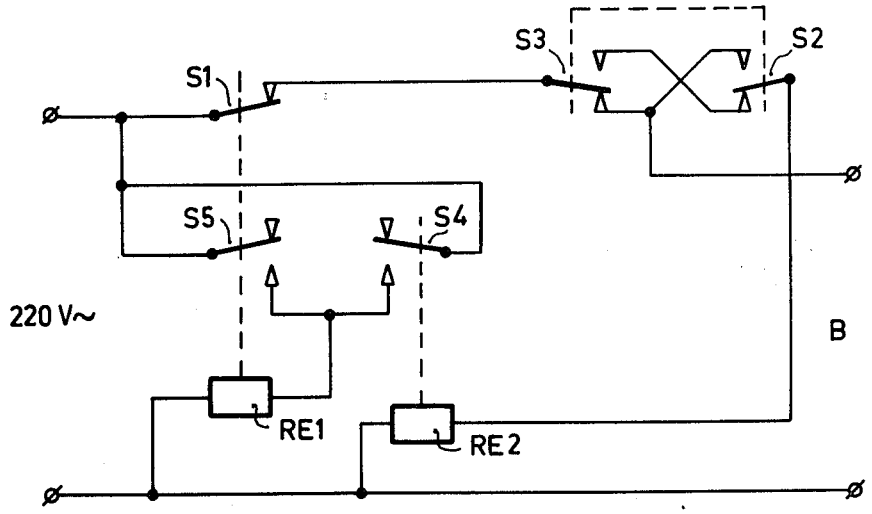
Fig.1 PRIOR ART
FIG. 1 shows a circuit diagram of a known switch failure monitoring device which is basic to the arrangement according to the invention.

FIG. 1 shows a switch failure monitoring device as described in DHEW (US Department of Health, Education and Welfare) publication No. (FDA) 72-8031 of May, 1972. In FIG. 1 RE1 is a power relay having a first contact S1 which is normally closed and a second contact S5 which is normally open. RE2 is a time-delay relay having a contact S4 which is normally open and S3, S2 are switches operated by the oven door. The switches S3 and S2 both have the shape of make-and-break contacts and are shown in the position they have when the door is closed. Relay contact S1 and the switch S3 (the break contact part of the same) are arranged in the supply line from the AC supply lines to the load B. The switch S2 is a monitoring switch for monitoring the operation of switch S3. The fixed contact elements in switches S2 and S3 are interconnected such that the current path between their movable contact elements will be closed only when the switches assume different positions, a so called "landing switch" circuit. This "landing switch" circuit is connected in series with the relay RE2 across the AC supply. Contact S4 of relay RE2 is connected in series with relay RE1 for energizing the relay RE1 in response to energization of relay RE2. The contact S5 is a holding current contact for RE1.

The operation is as follows.

In normal operation both relays RE1 and RE2 are nonenergized and contact S1 is closed. The AC supply voltage can be fed to the load B through switches S1 and S3 if the door is closed and S3 assumes the position shown. When the door is opened switch S3 will interrupt the current supply to the load but no actuation of relay RE2 will take place because there is no current path through S2, S3 in any condition of the door. The switches S2, S3 are mechanically adjusted so that they are actuated at approximately the same time, whereby there will not be any excitation of the relay RE2 during the closing and opening of the door.

However, if either of the switches S2, S3 sticks in the one or the other position the current path through S2, S3 will be closed upon opening or closing of the door, whereby relay RE2 is energized. Contact S4 closes and energizes the relay RE1, which is kept energized via contact S5. When RE1 is actuated contact S1 is opened and no voltage can be supplied to the load B. Thus, if either of the switches S3 or S2 fails to function normally the described arrangement will render the system inoperative until the cause of the failure is corrected.

Figure 2:
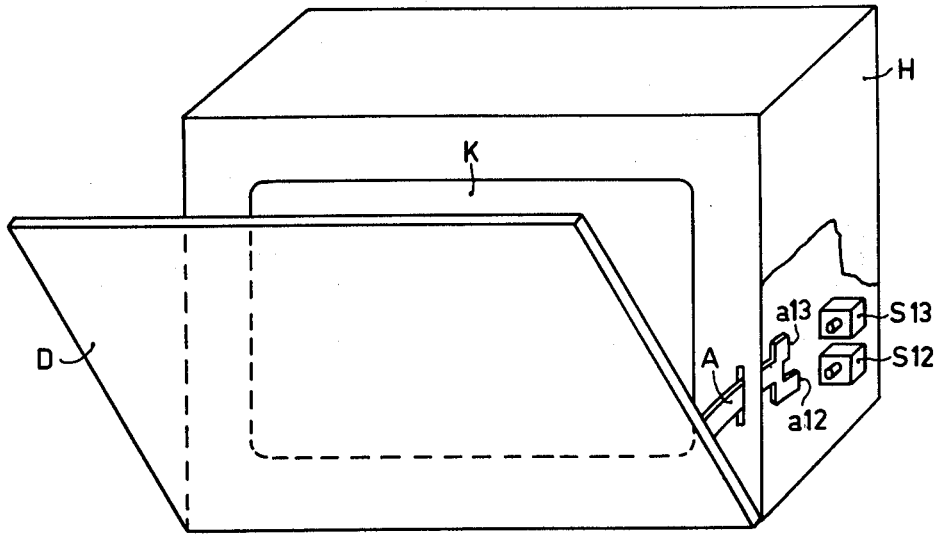
FIG. 2 shows a perspective view of an oven provided with door switches which are arranged in accordance with the invention.

FIG. 2 shows a simplified perspective view of a microwave oven, which comprises door switches included in a safety arrangement according to the invention. In FIG. 2 reference character H is an oven envelope, K is an oven cavity, D is an oven door and S13 and S12 are switches actuated by the door. The actuation of the switches S13, S12 takes place via an actuating arm A which is attached to the door. S13 is a switch which interrupts the current supply to the microwave source upon the opening of the door and corresponds to S3 in FIG. 1. S12 is a monitoring switch and corresponds to S2 in FIG. 1. According to the invention the door switch arrangement is such that S13 is always activated before S12 upon the opening of the door, which is schematically indicated in FIG. 2 in that the actuating surface a13 for the switch S13 on the actuating arm A is at a lower level than the corresponding actuating surface a12 for the switch S12.

Figure 3:
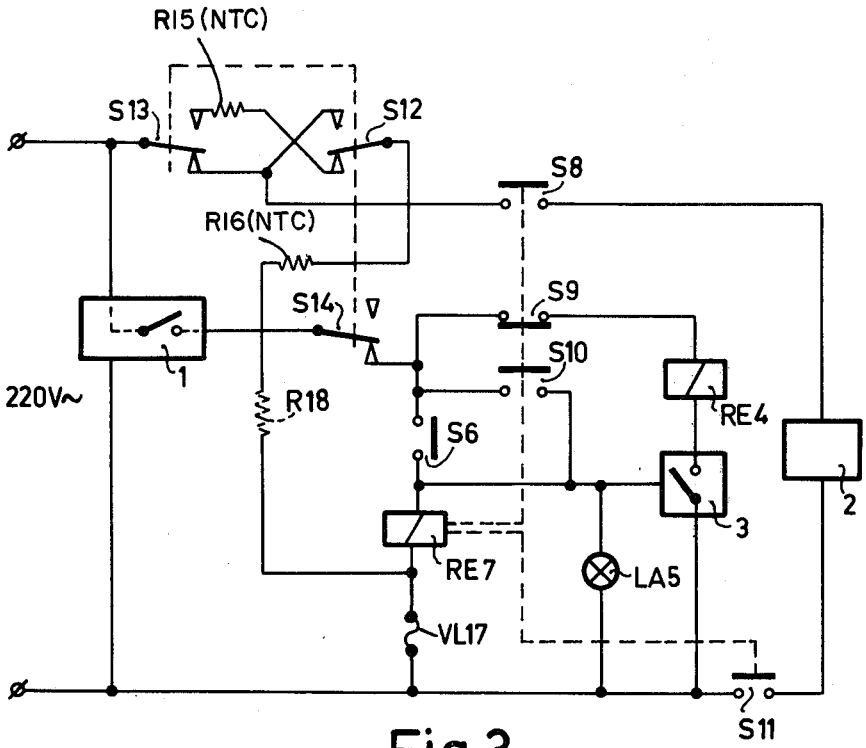
FIG. 3 shows a complete circuit diagram for a microwave oven with a safety arrangement according to the invention.

FIG. 3 shows a complete circuit diagram for a microwave oven provided with a safety arrangement according to the invention. In FIG. 3 reference numeral 2 designates a magnetron which is supplied with voltage from the AC supply lines via relay switches S8, S11, actuated by a relay RE7, and the said door switch S13. Both of the switches S13 and S12 have make-and-break contacts and are generally arranged in the same manner as S3 and S2 in FIG. 1 ("landing switch" circuit). Contacts S8, S11 are normally open and are made to close by actuation of the relay RE7. Relay RE7 is energized through a start switch S6, a door switch S14 and a device represented by the block 1 which, inter alia, comprises a timer. The relay RE7 furthermore has a normally open contact S10 which is a self-holding contact for RE7 and a normally closed contact S9. The contact S9 is arranged in series with a buzzer RE4 and a time circuit 3, which is adapted to bring the buzzer to emit sound a short time after the pre-set heating time has elapsed. LA5 is a lamp which indicates that heating is going on.

According to the invention a resistance R15, which can be a temperature dependent resistor with a negative temperature coefficient (NTC), is connected in one of the internal branches of the "landing switch" circuit S12, S13, namely in that branch which leads to the make contact (at the opening of the door) of S13. This door operated "landing switch" circuit S13, R15, S12 is connected across the AC supply in series with a second temperature dependent resistance R16 and a fuse VL17, which fuse also lies in the excitation path for the relay RE7. R16 prevents short-circuiting of the AC supply via the fuse.

The operation is as follows.

The oven is started by closing contact S6, whereby relay RE7 is energized and kept energized through contact S10. Magnetron 2 gets its supply voltage via door switch S13 and relay contacts S8, S11. When the pre-set time has elapsed heating is terminated because that the timer 1 de-energizes relay RE7. Should the oven door be opened while the supply voltage is still being fed to the magnetron, switch S13 will interrupt the current supply to the magnetron.

In normal operation of the door switches S12, S13 the switch S13 will, as mentioned, always operate before S12 upon the opening of the door so that the movable contact element of S13 will, for a short moment, assume the opposite position as compared with the one shown, while S12 is still in the position shown. Upon closing of the door, switch S12 will return to the position shown, while S13 is still in the opposite position. In both cases a current path will be closed momentarily in the "landing switch" circuit, which path comprises the NTC-resistance R15. During this short closing time of S12, S13 the fuse VL17 receives a voltage via R15 and R16. In view of the fact that both resistances R15 and R16 are connected in series with VL17 it will take a relatively long time, 1–10 seconds, preferably 2-3 seconds, before the fuse is burnt-off. This will minimize the risk of burning out the fuse for normal operation of the switches.

In contrast, if for example S13 got stuck in the position shown, in which it delivers voltage to the magnetron and which is the only really dangerous condition, a current path is closed in the "landing switch" circuit upon the opening of the door i.e. through that branch which comprises no resistance. The fuse VL17 gets voltage through R16 alone and will be burnt-off within a time period which is shorter than 0.5 seconds, preferably 0.2 to 0.3 seconds, as counted from the beginning of the opening of the door. When the fuse VL17 is burnt-off the relay RE7 is deenergized and the voltage supply to the magnetron is stopped via the opening of the relay contacts S8 and S11. If S12 gets stuck in the opposite position than that shown (non-dangerous) the same thing will happen upon closing of the door. If S12 gets stuck in the position shown or S13 in the opposite position (both cases non-dangerous) the fuse VL17 will get voltage via R15 and R16 in series so that it will be burnt-off after a time delay upon the opening and closing, respectively, of the door.

Thus, by means of the described arangement if, any of the switches S12 and S13 is faulty, the oven is made inoperative, in the dangerous case without delay upon the opening of the door, and cannot be started again unless the fuse and the defective switch is replaced. Furthermore the glow lamp LA5 now receives a voltage through RE7 - R16 -S12/S13 and thus emits light when the door is open, which is a warning signal. At the same time block 3 is activated through RE7 - R16 S12/13 which means that the buzzer RE4 emits a sound as soon as S14 is closed (i.e. the door is closed). This is also a warning signal. If the starting knob S6 will be pushed down with the door closed the lamp LA5 will emit light and the block 3 is activated through the block 1-S14-S6. The buzzer will also emit sound as a current path through is formed via the block 1-S14-S9-RE4-the block 3. This also is a warning signal.

In order to achieve the desired delay a temperature independent resistance R18 can be arranged in series with the temperature dependent resistance R16. It is also possible to connect several temperature dependent resistances in series for the same purpose.

Instead of a fuse other current circuit elements with a corresponding function also may be used, for example relays or switching units composed of semiconductors such as thyristors or the like. The switch S14 may possibly be omitted and the current supply to the relay coil be interrupted by the first switch (S13). Alternatively, the said switch S14, which interrupts the current to the relay coil, can instead be supervised and combined with a supervision switch (corresponding to S12) in the described manner. Of course, also both switches S13 and S14 can be supervised by special switches, such as S12.

What is claimed is:

1. A safety interlock arrangement for a microwave oven having a door and a microwave generator, comprising a first switch controlled by the oven door and connected to interrupt the current supply circuit to the microwave generator of the oven upon opening of the door, a second switch also controlled by the oven door and connected to monitor the operation of the first switch, both switches having make-and-break contacts with fixed contact elements thereof mutually interconnected to form a switching circuit in which a current path between the movable contact elements of the switches only arises when the two switches assume different relative positions, said switches each having predetermined first and second positions when the door is closed and when the door is open, respectively, means connecting the movable contact elements of the switches in a current path including a circuit control element which, when the said current path is closed, makes the oven unusable, the two switches being arranged so that the first switch operates before the second switch upon the opening of the door, and a delay means for delaying activation of said circuit control element and included in an internal branch of the switching circuit leading to the fixed contact element in the first switch which comes in contact with the movable contact element thereof when the door is open.

2. A safety interlock arrangement as claimed in claim 1 wherein said delay means comprises a negative temperature dependent resistor.

3. A safety interlock arrangement as claimed in claim 1 further comprising a temperature dependent resistor delay element included in the common branch of said current path that includes the two switches and said circuit control element.

4. A safety interlock arrangement as claimed in claim 1 wherein the current supply circuit of the microwave generator further comprises a relay contact of an electromagnet which in the operative condition of the microwave generator is kept closed by said electromagnet, a third door operated switch connected to keep the current supply circuit of the electromagnet closed in the closed position of the oven door and to interrupt a holding current path for the electromagnet upon opening of the door, and means further connecting said circuit control element in the holding current path for the electromagnet thereby to interrupt the holding circuit of the electromagnet when said circuit control element is activated.

5. A safety interlock arrangement as claimed in claim 4 wherein one terminal of said current path including the two switches and the circuit control element is connected to one pole of a supply current source for the oven and a second terminal thereof is connected to a junction point between the electromagnet winding and one terminal of said circuit control element, and means connecting the other terminal of the circuit control element to the second pole of the supply current source.

6. A safety interlock arrangement as claimed in claim 1 wherein said circuit control element is a fuse.

7. A safety interlock arrangement as claimed in claim 1 wherein the movable contacts of said first and second switches contact the respective break and make contacts thereof in the closed and open positions of the oven door, respectively, and said delay means interconnects the make and break contacts of the first and second switches, respectively, and means connecting the movable contact of the first switch to a terminal of the oven supply current source, the break contact of the first switch to the microwave generator current supply circuit, and the movable contact of the second switch to said circuit control element.

* * * * *